United States Patent [19]

Wolf

[11] Patent Number: 4,939,894

[45] Date of Patent: Jul. 10, 1990

[54] FUNNEL FOR A FUNNEL SPINNING APPARATUS ON A TEXTILE MACHINE

[75] Inventor: Horst Wolf, Albershausen, Fed. Rep. of Germany

[73] Assignee: Zinser Textilmaschinen GmbH, Fed. Rep. of Germany

[21] Appl. No.: 251,911

[22] Filed: Sep. 30, 1988

[30] Foreign Application Priority Data

Sep. 30, 1987 [DE] Fed. Rep. of Germany ..... 3732968

[51] Int. Cl.[5] ..... D01H 7/26; D01H 7/68

[52] U.S. Cl. ..... 57/115; 57/67; 57/74; 57/352

[58] Field of Search ..... 57/67–71, 57/115–117, 74, 127, 352, 354

[56] References Cited

U.S. PATENT DOCUMENTS 2,500,827 3/1950 Ickringill ..... 57/115
4,592,196 6/1986 Wolf ..... 57/67 X

FOREIGN PATENT DOCUMENTS 1053365 9/1959 Fed. Rep. of Germany .
3400327 7/1985 Fed. Rep. of Germany .
785485 10/1957 United Kingdom .
1030853 5/1966 United Kingdom ..... 57/67

*Primary Examiner*—John Petrakes
*Attorney, Agent, or Firm*—Shefte, Pinckney & Sawyer

[57] ABSTRACT

A yarn feeding funnel for a textile spinning machine having an upper shaft portion and a body portion. An axial yarn passage extends through the shaft portion and an outlet passage extends at an inclination downwardly and outwardly from the axial passage to an opening on the surface of the body portion. The body portion above the opening extends to a greater axial extent than the opening and may be an inverted frusto-conical shape or a torus shaped flange or a cylindrically shaped flange. Alternatively the opening may be in an annular recess in the body portion.

6 Claims, 1 Drawing Sheet

FUNNEL FOR A FUNNEL SPINNING APPARATUS ON A TEXTILE MACHINE

BACKGROUND OF THE INVENTION

The present invention relates to a funnel for a funnel spinning apparatus on a textile machine, and more particularly to such a funnel having an axial yarn feed passage and an outlet passage connecting the yarn feed passage to the outside of the funnel.

In the operation of a funnel spinning apparatus as disclosed in German Patent No. 34 00 327, yarn is fed through a yarn feed passage into the top of a funnel and to the outside of the funnel through a radially outwardly directed connection channel. Thereafter, the yarn travels in a spiral pattern along the outside surface of the funnel as it is wound onto the bobbin below the funnel. The bobbin is cyclically moved up and down in the inside of the funnel so that a yarn buildup gradually occurs on the bobbin during the spinning of the yarn thereon. The funnel includes a conical portion and a portion above the conical portion which is rotatably mounted so that the funnel is free to rotate. The funnel also incudes a generally cylindrical portion extending from the conical portion toward the lower end of the funnel.

The opening of the outlet passage on the outside of the typical prior art funnel is on the conical portion which is rather steeply conical in shape, widening downwardly in the direction of the bobbin. Also, the opening is at some distance above the interface between the conical portion and the generally cylindrical portion formed below it. Consequently, the yarn exiting the outlet passage must move radially outwardly before it overlies the generally cylindrical portion. The exiting yarn is thus subject to being forced radially outwardly away from the funnel, thereby leading to undesiable billowing or ballooning of the yarn from the funnel.

Accordingly, the need exists for a funnel for a funnel spinning apparatus of a textile machine which minimizes the tendency of the yarn to balloon outwardly from the funnel.

SUMMARY OF THE INVENTION

The present invention provides a yarn feeding funnel for a funnel spinning apparatus of a textile spinning machine to feed yarn onto a bobbin with a minimum of balancing and, therefore, with improved yarn control.

Briefly described, the yarn feeding funnel of the present invention includes an upper shaft portion having an axial yarn passage extending therethrough for passage of yarn therethrough, and a body portion extending downwardly from the upper shaft portion and having an outlet passage extending from the upper shaft portion to an opening in the body portion.

According to one feature of the present invention, the opening is lower than the downward extent of the shaft portion passage so that the yarn is fed to exit from the opening at a downward inclination to minimize ballooning. Preferably, the downward inclination of the outlet passage is approximately 120° from the axis of the shaft portion passage.

According to another feature of the present invention, the body portion has a radial extent above the opening greater than the radial extent of the opening to restrict upward movement of the yarn as it exits the opening so that ballooning is minimized.

With either feature, the body portion is formed with an inverted frusto-conical shape extending upwardly beyond the opening, or the shape may be a torus-shaped flange or cylindrically shaped flange or it may be in the form of an annular recess with the opening in the recess.

Other and further features and advantages of the present invention will be apparent from the accompanying drawings and the following detailed description of the preferred embodiment.

DETAILED DESCRIPTION OF PREFERRED EMBODIMENTS

Figure 1:
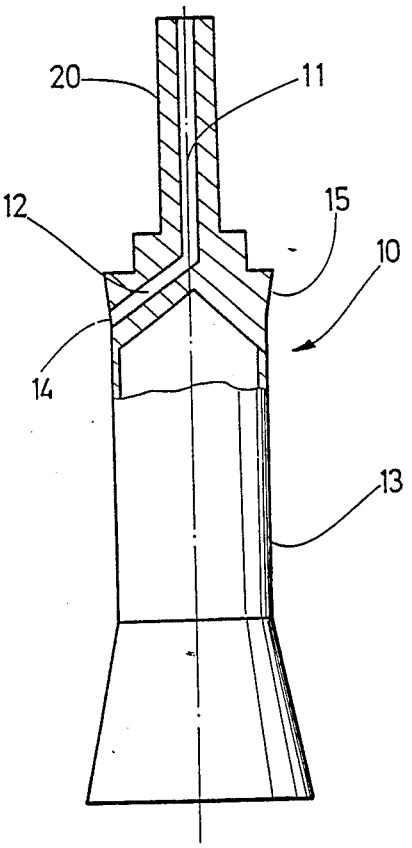
FIG. 1 is an elevational view of one preferred embodiment of the funnel of the present invention, partially in vertical section.

A funnel 10 of a preferred embodiment of the present invention for use in a funnel spinning apparatus of a textile machine is illustrated in FIG. 1. The funnel spinning apparatus in which this funnel is to be used is of the type described, for example, in German Patent No. 34 00 327 and is positioned below the drafting mechanism of the textile machine. The funnel 10 encircles, in a non-contacting manner, the upper portion of a rotating bobbin which is reciprocated vertically within and advanced out of the hollow lower end of the funnnel to build a yarn package on the bobbin.

The funnel 10 includes an upper shaft portion 20 having an axial yarn passage 11 extending vertically therethrough. A body portion 13, 15 extends downwardly from the shaft portion 20 and includes an outlet passage 12 extending from the passage 11 to an opening 14 that is lower than the downward extent of the axial yarn passage 11. With this arrangement the outlet passage 12 is inclined downwardly from the axial passage 11, preferably at an inclination of approximately 120° from the axis of the axial passage 11 of the shaft portion 20.

The body portion of the funnel 10 also includes, immediately below the opening 14, a portion 13 extending downwardly with a cylindrical shape followed by a conically outwardly flaring shape at its lower end. The body portion also includes a portion 15 above the opening 14 in an inverted frusto-conical shape, extending upwardly and outwardly to a radial extend above the opening 14 greater than the radial extend of the opening.

Yarn is fed from the drafting device of the textile spinning machine downwardly through the axial yarn feed passage 11 and outlet passage 12 to exit the funnel 10 at the opening 14. The yarn then travels along the surface of the funnel 10 in a generally spiral-like pattern as it is wound on the bobbin. The downward inclination of the outlet passage 12 imparts a downwardly directed component of movement to the yarn as the yarn exits the opening 14. As the opening 14 lies immediately above the juncture between the cylindrical portion 13 and the frusto-conical portion 15, it tends to travel on or in close proximity to the cylindrical surface of the portion 13. The greater radial extent of the frusto-conical portion 15 restricts upward movement of the yarn as it exits the opening 14 so that ballooning is minimized.

Figure 2:
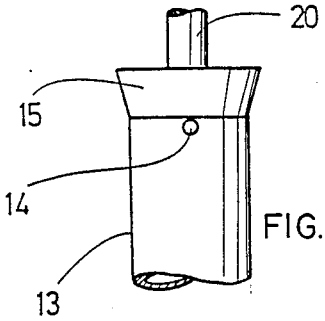
FIG. 2 is an elevational view of another preferred embodiment of the funnel of the present invention.

In FIG. 2, a second embodiment of the funnel 10 of the present invention is illustrated. This embodiment is identical to the embodiment of FIG. 1 described above with the exception that the opening 14 is located immediately below the juncture between the frusto-conical portion 15 and the cylindrical portion 13 so that the yarn exits directly onto the cylindrical portion 13.

Figure 3:
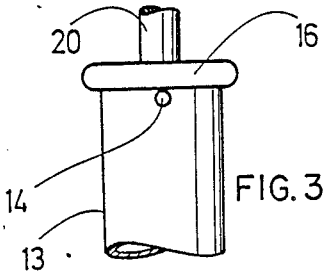
FIG. 3 is an elevational view of an alternative embodiment of the funnel of the present invention.

In FIG. 3, an alternative embodiment of the funnel 10 of the present invention is illustrated. This embodiment is identical to the embodiment of FIG. 2 except that the portion 15 above the opening 14 is a torus-shaped flange 15 extending to a greater radial extent than the opening 14.

Figure 4:
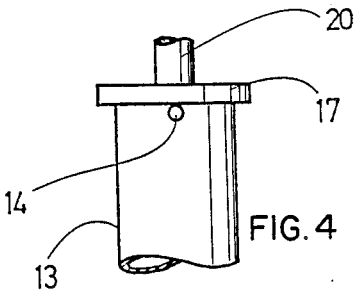
FIG. 4 is an elevational view of another alternative embodiment of the funnel of the present invention.

In FIG. 4, another alternative embodiment of the funnel 10 of the present invention is illustrated. This embodiment is identical to the embodiment of FIG. 2 except that the portion 15 above the opening 14 is a cylindrically shaped flange 15 extending to a greater radial extent than the opening 14.

Figure 5:
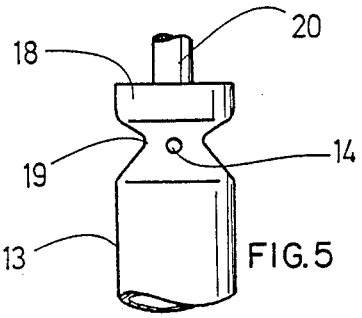
FIG. 5 is an elevational view of a modified embodiment of the funnel of the present invention.

In FIG. 5, a modified embodiment of the funnel 10 of the present invention is illustrated. In this embodiment the body is formed with an annular recess 19 below a top portion 18. The portion of the recess 19 between its smallest diameter portion and the top portion 18 extends substantially radially with respect to the axis of the funnel while the portion between its smallest diameter portion and the cylindrical portion 13 is oriented at a relatively substantial angle with respect to the radial direction of the funnel. In this embodiment the funnel 10 of the present invention assures that the yarn exiting the opening 14 is urged downwardly and is restrticted against upward movement.

It will therefore be readily understood by those persons skilled in the art that the present innvention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A yarn feeding funnel for feeding yarn onto a spindle of a textile spinning machine, comprising:

an upper shaft portion having an axial yarn passage extending vertically therethrough for passage of yarn therethrough; and a body portion extending downwardly from said upper shaft portion, said body portion having a lower circumferential rim and having an outlet passage extending from said upper shaft portion passage to an opening in said body portion, said body portion having a radial extent above said opening greater than the radial extent of said opening, said body portion supporting yarn traveling in a path from said outlet passage, across said lower circumferential rim and onto a spindle of the textile spinning machine and said body portion permitting circumferential movement of yarn along said lower circumferential rim during travel of the yarn thereacross.

2. A yarn feeding funnel according to claim 1 and characterized further in that said body portion has an inverted frusto-conical shape above said opening that extends to said greater radial extent.

3. A yarn feed funnel according to claim 1 and characterized furhter in that said body portion has a torus shaped flange above said opening and extending to said greater radial extent.

4. A yarn feeding funnel according to claim 1 and characterized further in that said body portion has a cylindrically shaped flange above said opening and extending to said greater radial extent.

5. A yarn feeding funnel according to claim 1 and characterized further in that said body portion is formed with an annular recess below said greater radial extent, and said opening is in said annular recess.

6. A yarn feeding funnel for feeding yarn onto a spindle of a textile spinning machine, comprising:

an upper shaft portion having an axial yarn passage extending vertically therethrough for passage of yarn therethrough; and a body portion having a lower circumferential rim, said body portion extending downwardly from said upper shaft portion to said lower circumferential rim and having an outlet passage extending from said upper shaft portion passage to an opening in said body portion lower than the downward extent of said shaft portion passage, said body portion having an inverted frusto-conical shape extending upwardly beyond said opening and said body portion supporting yarn traveling in a path from said outlet passage, across said lower circumferential rim and into a spindle of the textile spinning machine and said body portion permitting circumferential movement of yarn along said lower circumferential rim during travel of the yarn thereacross.

* * * * *